United States Patent [19]

Meyer

[11] Patent Number: 4,799,735

[45] Date of Patent: Jan. 24, 1989

[54] CHAIR OR ARMCHAIR

[75] Inventor: Just B. Meyer, Rhenen, Netherlands

[73] Assignee: Kembo B.V., Netherlands

[21] Appl. No.: 50,244

[22] Filed: May 15, 1987

[30] Foreign Application Priority Data

Jul. 1, 1986 [DE] Fed. Rep. of Germany ..... 3622028

[51] Int. Cl.[4] ..... A47C 7/00

[52] U.S. Cl. ..... 297/440; 108/156; 248/188.8; 297/DIG. 1; 297/445

[58] Field of Search ..... 297/DIG. 1, 445, 440; 248/188.8; 108/156

[56] References Cited

U.S. PATENT DOCUMENTS

| | | | |
|---|---|---|---|
| 3,111,344 | 11/1963 | Hoven et al. | 297/452 |
| 3,450,435 | 6/1969 | Stephens | 297/446 |
| 3,698,150 | 10/1972 | Anderson | 297/442 X |
| 3,873,154 | 3/1975 | Baker, Jr. | 297/445 |
| 3,970,401 | 7/1976 | Lubeck | 297/DIG. 1 |
| 4,123,105 | 10/1978 | Frey et al. | 297/451 |
| 4,318,570 | 3/1982 | Adam et al. | 297/445 |
| 4,348,053 | 9/1982 | Strassle | 297/445 |
| 4,545,615 | 10/1985 | Kane | 297/445 X |

FOREIGN PATENT DOCUMENTS

| | | | |
|---|---|---|---|
| 1246196 | 10/1967 | Fed. Rep. of Germany . | |
| 2010012 | 9/1971 | Fed. Rep. of Germany | 297/DIG. 2 |
| 2118216 | 12/1971 | Fed. Rep. of Germany . | |
| 7428403 | 8/1974 | Fed. Rep. of Germany . | |
| 1505526 | 11/1967 | France . | |
| 1528766 | 6/1968 | France . | |
| 1584385 | 7/1969 | France . | |
| 2189190 | 6/1974 | France . | |
| 2242054 | 4/1975 | France . | |
| 2378475 | 10/1978 | France . | |
| 725720 | 7/1954 | United Kingdom . | |

*Primary Examiner*—James T. McCall

*Attorney, Agent, or Firm*—Ostrolenk, Faber, Gerb & Soffen

[57] ABSTRACT

The invention relates to a chair or armchair with legs, and a seat and a backrest made in one piece with the seat. So that a chair or armchair of this type can be made stable and rigid, while preserving the essential advantages of production from plastic, at the same time making it possible for the chair or armchair to have a pleasing appearance, the legs are designed as plastic hollow parts, in which metal tubes have been received as stiffening elements.

16 Claims, 6 Drawing Sheets

CHAIR OR ARMCHAIR

BACKGROUND OF THE INVENTION

The invention relates to a chair or armchair with legs, a seat and a backrest made in one piece with the seat.

THE OBJECT OF THE INVENTION

The main object on which the invention is based is to provide a chair or armchair which, whilst preserving the essential advantages of being produced from plastic, will meet the stringent requirements demanded of it, on the one hand in terms of its structure, for example with excellent characteristics as regards rigidity and stability, and on the other hand also in terms of a pleasing appearance. Another object is to assure that the user will sit comfortably.

SUMMARY OF THE INVENTION

According to the invention the legs are designed as plastic hollow parts, in which metal tubes are received as stiffening elements.

It thus becomes possible, in principle, to produce it easily and simply from plastic and, at the same time, obtain a high degree of rigidity.

Although the metal tubes can have a round cross-section, they are nevertheless preferably of rectangular, more preferably square shape. This prevents the metal tubes and the plastic parts from rotating relative to one another. Steel can be used as the metal.

There are several possible solutions for constructing the plastic hollow parts forming the legs and for connecting these hollow parts and the metal tubes to one another. It is especially simple and effective if each leg consists of two plastic halves with joining faces extending parallel to the side face of the chair or armchair.

It is also preferred if the two plastic halves have inward-projecting parts with snap-in edges or snap-in teeth which interact with snap-in orifices in the metal tubes.

It is advantageous if either the metal tubes project a small amount from the plastic legs at the bottom, or the metal tubes terminate at the bottom at a short distance above the lower ends of the plastic legs and footpieces are inserted in the metal tubes and project a small amount from the plastic legs at the bottom. In both cases, the plastic hollow parts are relieved of stress, and the load is transmitted to the floor by means of the metal tubes. In particular, this measure makes it possible, for example, to keep the thickness of the material of the plastic hollow parts restricted to 3 to 5 mm.

The assembly work can be reduced considerably, if the inner plastic halves of a front and a rear leg are produced integral with an essentially horizontal element limiting or supporting the side edge of the seat, whilst the outer plastic halves of the front and/or rear leg are parts which are produced separately and which are snapped onto the tubes as leg caps.

Moreover, because the leg halves are produced integral with the horizontal element, the chair or armchair functions perfectly over a long period of time, and it becomes possible to obtain a shape which is aesthetically of very pleasing appearance.

Where rigidity and stability are concerned, it is notable that the horizontal element can be designed as a profiled plastic part open towards the inside of the chair or armchair, without any metal stiffening. The metal tubes as stiffening elements therefore only need to be accommodated in the legs. It is even possible to select a design in which the inner plastic halves of the legs are arranged outside the outer face of the horizontal element, the transitions between the inner plastic halves and the horizontal element being rounded.

The appearance of the chair or armchair with a so-called bucket or cask made of plastic can be improved considerably, if there is a backrest part which comprises at least one back wall with two side walls and which can be fastened between the rear legs by means of these side walls, the backrest, produced as a cask in one piece with the seat, being fastened against the side walls of the rear backpiece.

This results in a boxed construction for the back, thus not only giving the impression of great solidity, but also actually making a contribution to the stability of the chair or armchair.

A particular advantage is also that several chairs or armchairs can be lined up in a row by means of a continuous rod, without the rod being visible, because it extends through the cavity inside the backrest part.

The invention is explained in detail below with reference to a drawing illustrating an exemplary embodiment.

SHORT DESCRIPTION OF THE DRAWINGS

FIGS. 1–3 are perspectives of an armchair looking toward the front, the rear and the right-hand side, respectively, thereof, FIG. 4 shows a side view from outside of the right-hand side half of an armchair, FIGS. 5 and 6 show respectively a front and a rear-view of the right-hand side half of FIG. 4, FIGS. 7–11 show sectional views of details on an enlarged scale along the lines VII—VII to XI—XI in FIG. 4, FIG. 12*a* shows a vertical section along the lines XIIa—XIIa in FIG. 12*b* and FIG. 12*b* shows a section along the lines XIIb—XIIb in FIG. 12*a*, FIG. 13 shows a backrest part from the rear in the left half A and from the front in the right half B, FIG. 14 shows a side view of the part illustrated in FIG. 13, FIG. 15 shows a horizontal cross-section through the backrest part along the line XV—XV in FIG. 14, and FIG. 16 shows a partial cross-sectional view of the armchair along the line VIII—VIII in FIG. 4, but in the finished position in which the seat is connected to the side piece.

DESCRIPTION OF THE PREFERRED EMBODIMENT

Figures 1, 2, 3:
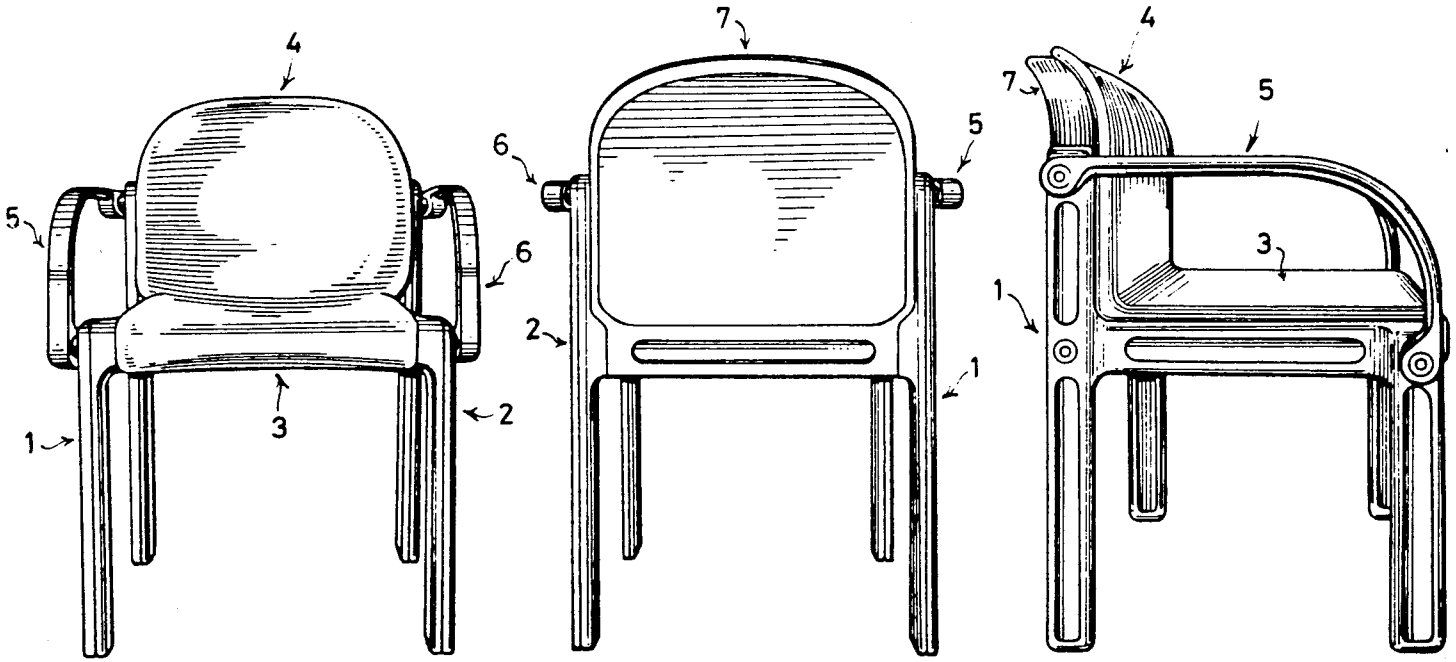

As appears from FIGS. 1–3, the armchair is basically composed of a left-hand and a right-hand side part 1 and 2, a seat 3 and a backrest 4. The seat 3 and the backrest 4 are produced in one piece, as is known per se; this piece is also called a bucket or cask. In an armchair version, the two armrests 5 and 6 can be provided, or they can be omitted in the similar chair version. A backrest part 7 is also provided behind the backrest 4.

The side part 1 is shown separately in FIGS. 1–6, with a series of details illustrated in FIGS. 7–12. As emerges clearly from FIG. 4, the side part is made h-shaped. It is composed of an essentially horizontal element 8, the essentially horizontal element 8 is designed as a profiled part open towards the inside of the armchair. This element serves, in general, for supporting or at least limiting the seat.

Figures 4, 5, 6:
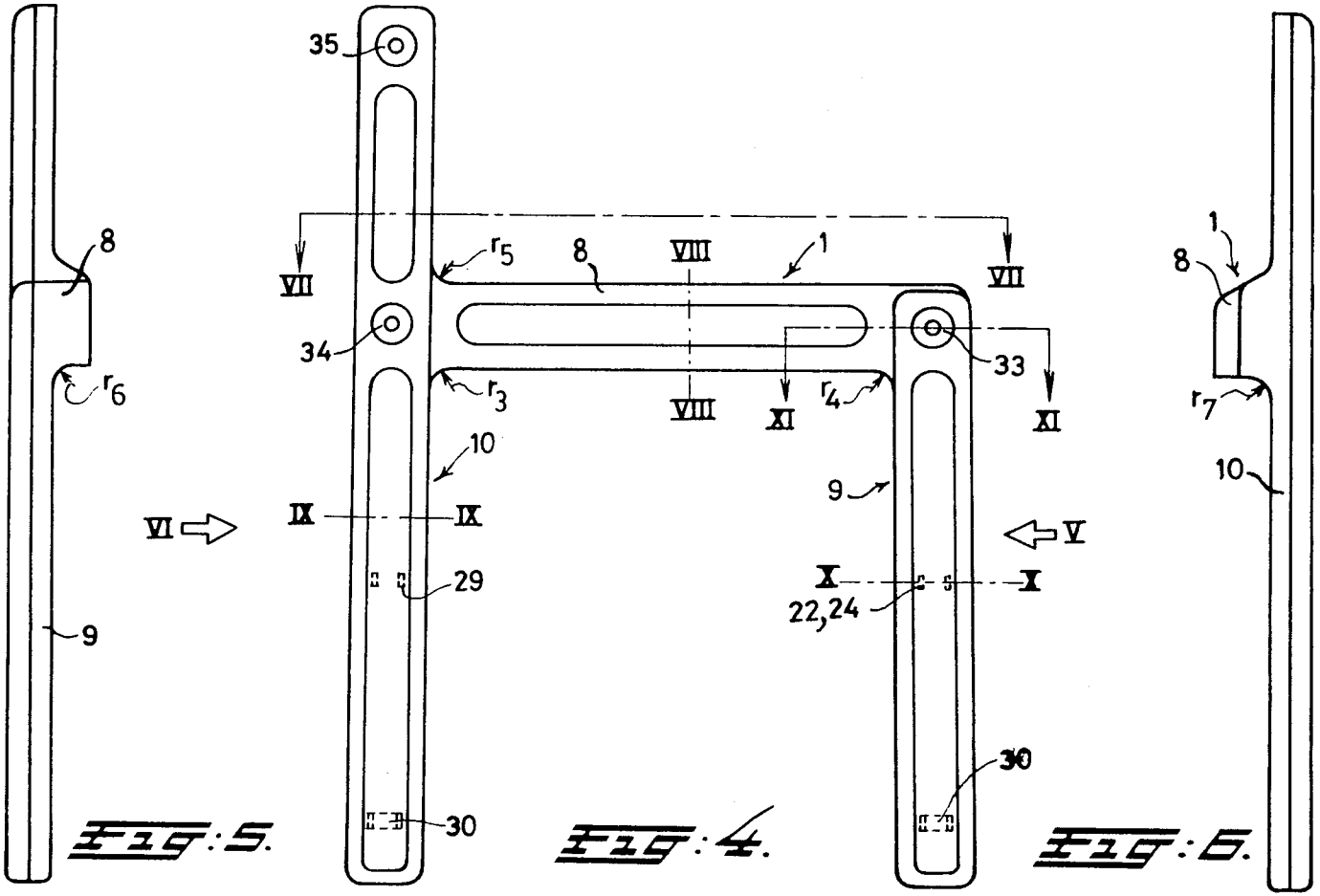
Figure 7:
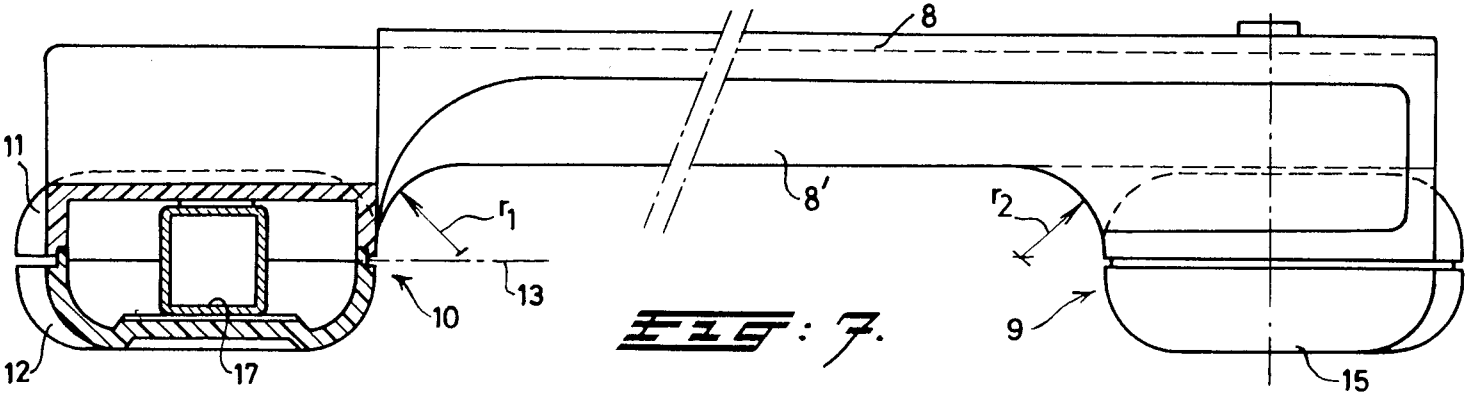
Figure 11:
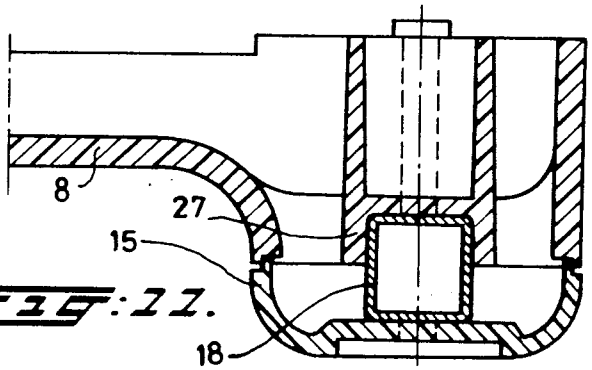

FIG. 7 illustrates a horizontal cross-section at the height VII—VII of the side part (see FIG. 4) and is therefore a plan view of the element 8. It appears from FIG. 7 that the two legs 9 and 10 are located outside the outer face 8' of the horizontal element 8. The rear leg 10 is composed of two halves 11 and 12 which are designed as shell parts with adjoining face 13 parallel to the side face 8' of the element 8. The inner half 11' is made in one piece with the element 8. The outer half 12 forms a leg cap which is snapped on in a way yet to be described. As appears from FIG. 9, the construction of the rear leg 10 underneath the element 8 is basically the same.

Figure 10:
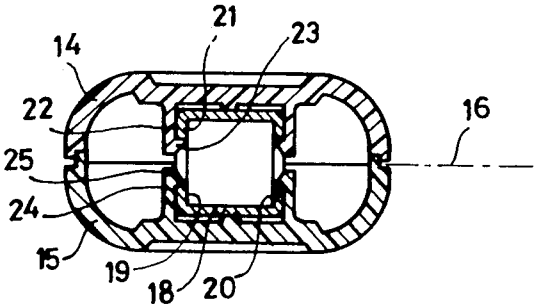
Figure 1B:
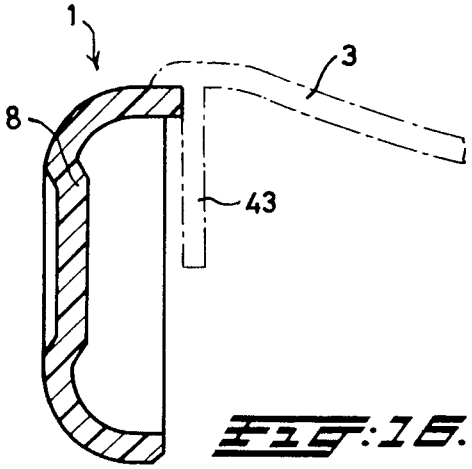

The front leg 9 is composed in a similar way of an inner half 14 and outer half 15 which are designed as shell parts with a joining face 16 parallel to the outer face 8' of the element 8, as is evident from FIG. 10. The one-piece connection of the inner leg half 14 to the horizontal element 8 is shown particularly in FIG. 11. As in the rear leg, the outer half 15 is designed as a cap.

The parts described hitherto are preferably all produced from plastic and are therefore hereafter also called plastic halves, plastic shells, etc.

Figure 9:
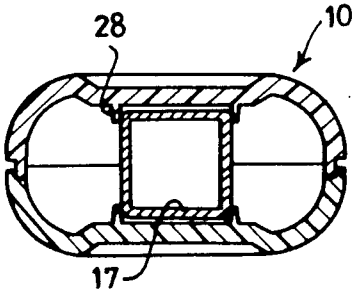

A metal tube 18, 17 is received as a stiffening element in each of the two legs 9 and 10 (see FIGS. 10 and 9). These metal tubes extend through the legs essentially over the entire height. Reference is made once again to FIG. 10 for the method of fastening the metal tube and the plastic parts of the leg to one another. The tube 18, for example at the height where the cross-section is taken, has orifices, one of which bears the reference numeral 21, in each of the two walls 19 and 20 designated here as side walls. On the inside, the plastic shell 14 carries two projecting parts, one of which is designated by 22; each projecting part has a snap-in edge or snap-in tooth 23 at the end. In a similar way, the outer plastic shell 15 is equipped with projecting parts 24 having snap-in edges or teeth 25. The snap-in edges 23 and 25 interact as a snap fastening with the orifices 21 in the metal tube. For the purpose of fastening, therefore, the metal tube 18 can first be connected to the inner shell 14 of the leg by a snap action, after which the outer shell or cap 15 is then snapped onto the tube 18. This results in a direct connection between each of the two plastic shells 14 and 15 and the metal tube whilst the two plastic parts 14 and 15 are held against one another by means of an indirect or, once again, a direct connection.

Such snap connections only need be provided in a limited number of places. In FIG. 4 in the front leg 9 the projecting parts 22, 24 in the inner cavity are marked by broken lines at the height of the cross-section X—X. The restricted height dimension of the projecting parts 22, 24, that is to say the dimension in the vertical direction of the leg, emerges from this at the same time. In FIG. 4, similar projecting parts 29 are evident at the same height with the rear leg 10. Near the top end of the front leg 9, the connecting region between the leg and the horizontal element 8 offers the possibility of providing webs or ribs 27 for fixing the mutual positions of the plastic part and metal tube laterally. At other heights, the plastic parts can have similar, but shorter ribs which are in the extension of the ribs 27 along the lines joining the projecting parts 22, 24. Such smaller ribs are given, for example, the reference numeral 28 in FIG. 9. The same principle of the snap connection is used for the rear leg 10; in FIG. 4, these snapping means are designated simply by 29.

Figure 12B:
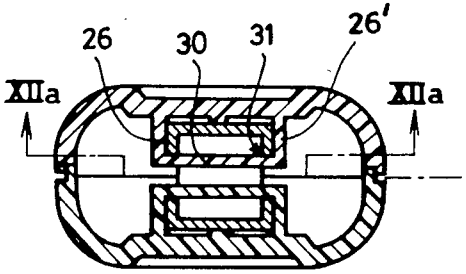
Figure 12A:
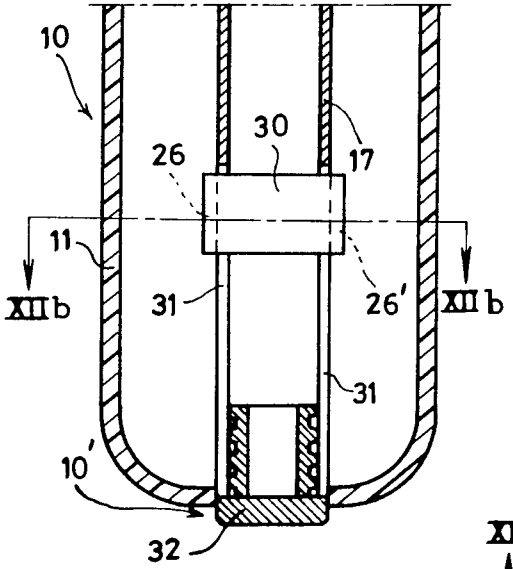
Figure 8:
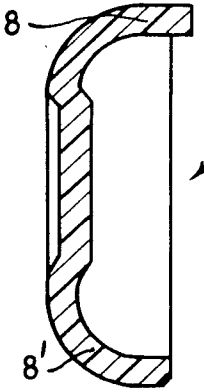

FIG. 12*a* shows that the metal tube 17 terminates at a short distance in front of the lower end 10' of the leg 10, but that a footpiece 32 projecting from the leg end 10 is inserted into the tube 17 at the bottom and serves as a standing surface for the leg. Alternatively, the metal tube 17 itself can project from the leg end 10' at the bottom. In both cases, the load is absorbed completely by the metal tube and the plastic parts of the leg are relieved of stress. The front leg 9 is designed in the same way.

Close to the lower part of each leg a snap-in connection may be provided. FIGS. 12*a* and 12*b*, however, show yet another solution at these places. In principle situated in alignment with the ribs 27 and the projecting parts 22, 24 there are portions such as 26, 26' formed integral with the shells such as 14; in the present embodiment these portions are interconnected by parts 30 so that eyes are formed. The metal tubes such as 17, 18 present orifices such as 31, similar to apertures 21, but realised here as slits which are open at the bottom end of each leg (compare FIG. 12*a*) so that the lower end of each tube 17 is bifurcated to form the legs which. When mounting the chair first the remaining portions of the tubes 17, 18 beside the slits 31 are inserted into the eyes formed by 26, 26' and 30. Therefore, at higher levels, the snap-in connections such as 22, 24, 29 are made and so forth. Finally an end piece such as 32 is inserted into each leg, connecting the shells undetachably with the stiffening tubes 17, 18.

The metal tubes 17, 18 received in the legs 9, 10 give the armchair excellent rigidity and stability, so that the plastic material, from which the other parts of the side piece 1 are produced, only need have a wall thickness of no more than 3 to 5 mm, and can be relatively flexible. It should be noted that the essentially horizontal element 8 of the side part 1 or 2 does not need any metal stiffening. However, it is beneficial to stability if the various transitional regions having a sufficiently large radius of curvature have roundings. These are, above all, roundings designated by $r_1$ and $r_2$ in FIG. 7 and by $r_3$, $r_4$ and $r_5$ in FIG. 4, and finally those designated by $r_6$ and $r_7$ in FIGS. 5 and 6. According to the invention, these radii have values of between approximately 15 and approximately 20 mm, so that the load exerted on the seat is transferred to the legs 9 and 10 by means of the horizontal element 8 via the rounded transitional regions.

Figure 13:
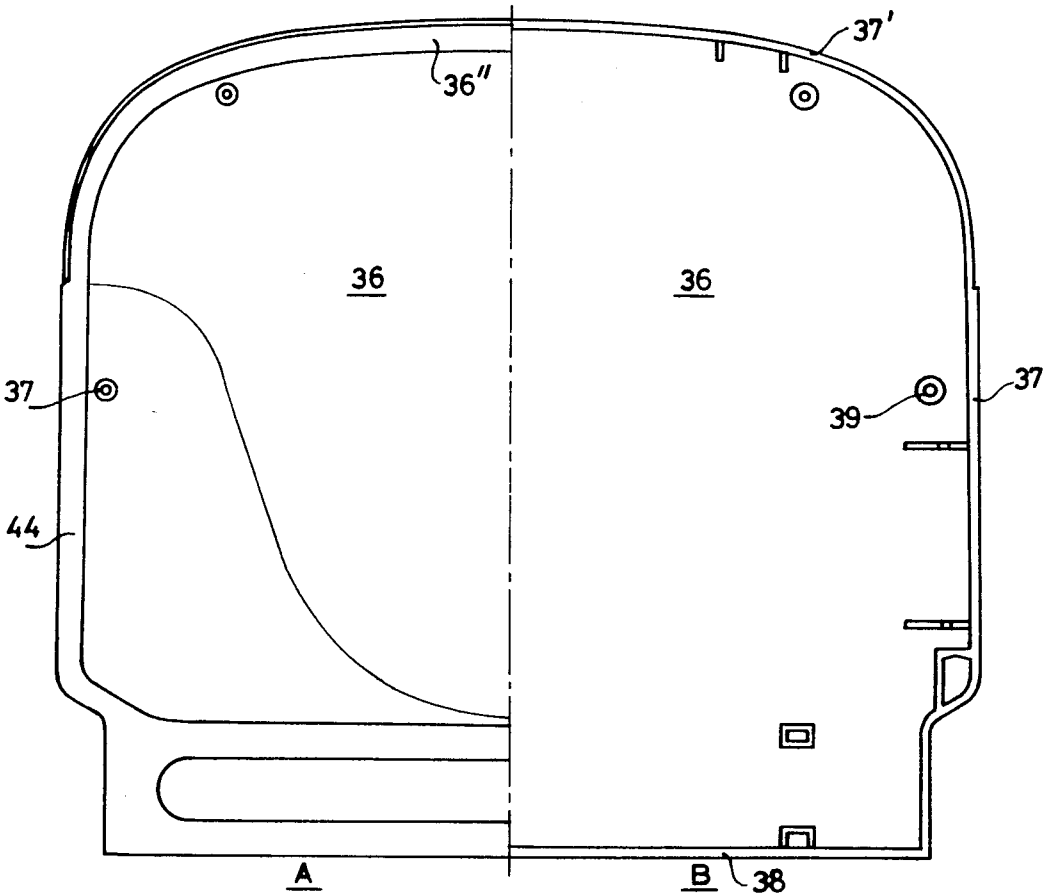
Figure 14:
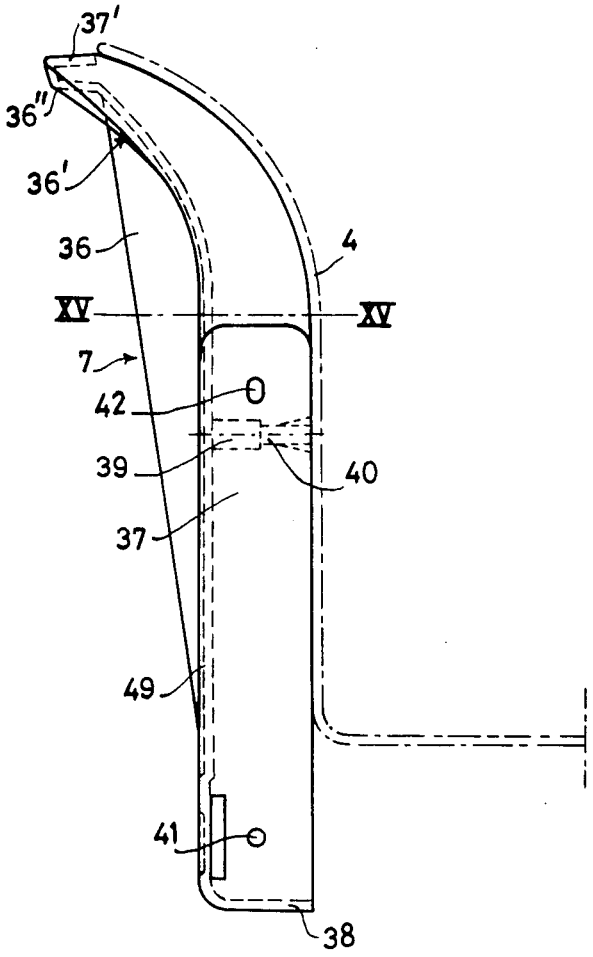
Figure 15:
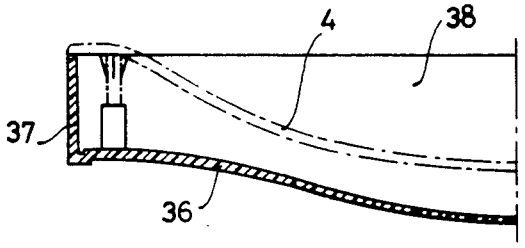

The side part 1 described has holes 33, 34 and 35 for connection to the cask forming the seat 3 and the backrest 4 and the backrest part 7. The backrest part 7 is shown in FIGS. 13 and 15. It has a back wall 36 which is limited on both sides by side walls and at the bottom by a bottom wall 38. The back wall is arched and is essentially the same shape as the actual backrest 4 represented by dot-and-dash lines in FIGS. 14 and 15. The arch of the back wall 36 of the backrest part 7 in the transverse direction therefore essentially matches the shape of the user's back. As seen in the side view according to FIG. 14, a rearward bend 36' is made in the rear wall 36, in such a way that the wall terminates in a gripping edge 36" extending essentially horizontally.

The backrest 4 lies on its end face against the side walls 37 of the backrest part 7 (see FIG. 15). The side walls 37 follow the margin of the back wall 36 and thus also gradually merge into an upper limitation 37' (FIG. 14). The backrest 4 is thus already supported over a considerable part of its circumference. To improve the stability of the support, the back wall 36 has stays 39 formed on in several places and projecting into the cavity. These stays 39 can extend forwards, as represented by broken lines in figure 14. But similar stays 40 can also be formed on the rear face of the backrest 4 in corresponding places, in such way that the stays 39 and 40 meet one another and constitute retention means for the backrest. The stays 39 and 40 can be made hollow and can be used for the provision of positive connection means, such as screws.

In the side walls 37, the backrest part 7 has holes 41 and 42 which are aligned with holes 34 and 35 in the side parts, so that side parts of adjacent chairs can be connected to one another. For connecting chairs singly, simple bolts can of course be used for this purpose. However, a possibility which shall be mentioned particularly is to align several chairs or armchairs in a row by inserting continuous rods through the holes 41, 34 and 43, 35, this being known per se. But here these rods can be located in the inner cavity of each backrest part and are therefore not visible.

As stated above, the backrest 4 is made in one piece with the seat 3; this plastic part as a whole is called a bucket or cask. FIG. 16 also shows how, in the present preferred embodiment, the connection is made between the seat 3 and the essentially horizontal element 8 of the side piece. In principle, a seat can rest on top of such a horizontal element and, if appropriate, be flanged to it on the outside. In the present case, however, the seat has a downward-directed flange 43 which rests against the open side of the profile of the element 8. Bolt or screw connections to the cask can be provided at the holes 33.

The plastic cask 3, 4 can be mounted between the two side pieces without any further support. It is possible, however, to upholster the cask with materials of greatly varying types and qualities, with the result that chairs or armchairs are produced in different versions in the simplest possible way. As regards this upholstery, on the backrest part the back wall 36 can also be recessed a few millimeters in a peripheral region 44. A layer of upholstery of the same material as on the front side of the bucket can then be accommodated in this recessed surface.

Finally, it may also be mentioned at this juncture that the construction according to the invention makes it possible in a simple way to provide several versions of one and the same model by attaching upholstery of a particular quality to the cask as a plastic part. It is also advantageous, for this purpose, if the back wall of the backrest part is at least partially recessed in an edge region and if upholstery is arranged in this recess.

What is claimed is:

1. A chair or armchair including:

a seat (3) and a backrest (4) integral with said seat to constitute a cask, a plurality of hollow plastic legs (9, 10) extending below said seat to maintain the latter in a raised generally horizontal position, and metal tubes (17, 18) disposed within said legs to stiffen same;

each of said legs comprising first and second plastic halves (14, 15, 11, 12) which have a joining face (16, 13) extending generally parallel to a side of said chair;

said plastic halves including inward projecting portions (22, 24) having snap-in edge formations (23, 25) which interact with snap-in orifices (21) in the metal tubes (17, 18) for holding the latter and said plastic halves (14, 15, 11, 12) together as a unit.

2. A chair or armchair as in claim 1 in which each of said metal tubes (17, 18) is of rectangular preferably square cross-section, and the snap-in orifices (21) are in forward and rear facing surfaces (19, 20) of the metal tubes (17, 18).

3. A seating assembly including:

a seat (3), a plurality of hollow plastic legs (9, 10) extending below said seat to maintain the latter in a raised generally horizontal position, and metal tubes (17, 18) disposed within said legs to stiffen same;

each of said legs comprising first and second plastic halves (14, 15, 11, 12);

said plastic halves including inward projecting portions (22, 24) having snap-in edge formations (23, 25) which interact with snap-in orifices (21) in the metal tubes (17, 18) for holding the latter and said plastic halves (14, 15, 11, 12) together as a unit.

4. A seating assembly including:

a seat (3), a plurality of hollow plastic legs (9, 10) extending below said seat to maintain the latter in a raised generally horizontal position, and metal tubes (17, 18) disposed within said legs to stiffen same;

each of said legs comprising first and second plastic halves (14, 15, 11, 12);

each of said tubes (17, 18) including bifurcated portions formed by a longitudinal slit (31) which extends from a tube end partway along the length of said tube;

said plastic halves including inward formations (26, 30, 26) which define eyes, each of which receives an individual one of said bifurcated portions for holding the metal tubes (17, 18) and said plastic halves (14, 15, 11, 12) together as a unit.

5. Chair or armchair as in claim 1, wherein in order to fix the mutual positions of the plastic halves (11, 12, 14, 15) in relation to the metal tubes, the plastic halves have, in the transverse direction, ribs which extend essentially over the entire leg length along imaginary lines joining the portions (22, 24) having the snap-in edge formations (23, 25).

6. Chair or armchair as in claim 1, wherein the metal tubes (17, 18) project a small amount from the plastic legs (9, 10) at the bottom thereof.

7. Chair or armchair as claim 1, wherein the metal tubes terminate at the bottom at a short distance above the lower ends (10') of the plastic legs (9, 10), and foot pieces are inserted into the metal tubes and project a small amount from the plastic legs (9, 10) at the bottom thereof.

8. Chair or armchair as in claim 1, wherein the inner plastic halves (14, 11) of a front and a rear leg (9, 10) are integral with an essentially horizontal element (8) that supports the side edge of the seat whilst the outer plastic halves (15, 12) of the front and/or rear leg (9, 10) are separate parts which are snapped onto said tubes as leg caps.

9. Chair or armchair as in claim 8, wherein said horizontal element (8) is a profiled plastic part open towards the inside of the chair.

10. Chair or armchair as in claim 8, wherein the inner plastic halves (14, 11) of the legs (9, 10) are arranged laterally outside the outer face (8') of the horizontal element (8), and there are rounded transitions between the inner plastic halves and the horizontal element.

11. Chair or armchair as in claim 8, wherein the inner plastic halves (14, 11) of the legs (9, 10) are arranged laterally outside the outer face (8') of the horizontal element (8), the transitions between the inner plastic halves and the horizontal element being rounded and having radii of curvature ($r_1$–$r_7$) of approximately 15 to approximately 20 mm.

12. Chair or armchair as in claim 1, having a backrest part (7) which comprises at least one back wall (36) with two side walls (37) and which is fastened between the rear legs by means of these side walls, and the backrest (4) being attached against the side walls (37) of the rear backpiece (36).

13. Chair or armchair as in claim 12, wherein said backrest (4) lies on its end faces against the side walls (37) of the back wall (36), and in that said backrest part (7) and/or the backrest (4) has parts (39, 40) projecting into the cavity of the backrest part (7), thereby forming retention means or supporting points for the backrest (4) relative to the backrest part (7).

14. Chair or armchair as in claim 12, wherein the backrest part is curved rearwards at the top (at 36') and terminates in a gripping edge (6, 11) directed essentially horizontally rearwards.

15. Chair or armchair as in claim 12, wherein said cask (3, 4) is produced as a plastic part which is equipped with upholstery.

16. Chair or armchair as in claim 15, wherein the back wall (36) of said backrest part is at least partially recessed in an edge region (44) and upholstery is arranged in the recess formed.

* * * * *